US010160203B2

(12) United States Patent
Martin et al.

(10) Patent No.: US 10,160,203 B2
(45) Date of Patent: Dec. 25, 2018

(54) PRINTHEAD FIRE SIGNAL CONTROL

(71) Applicant: HEWLETT-PACKARD DEVELOPMENT COMPANY, L.P., Houston, TX (US)

(72) Inventors: Eric T Martin, Corvallis, OR (US); Christopher Hans Bakker, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/518,917

(22) PCT Filed: Oct. 29, 2014

(86) PCT No.: PCT/US2014/062792

§ 371 (c)(1),
(2) Date: Apr. 13, 2017

(87) PCT Pub. No.: WO2016/068894

PCT Pub. Date: May 6, 2016

(65) Prior Publication Data

US 2017/0239944 A1 Aug. 24, 2017

(51) Int. Cl.
*B41J 29/38* (2006.01)
*B41J 2/045* (2006.01)

(52) U.S. Cl.
CPC ..... *B41J 2/04543* (2013.01); *B41J 2/0455* (2013.01); *B41J 2/0458* (2013.01); *B41J 2/04541* (2013.01); *B41J 2/04588* (2013.01)

(58) Field of Classification Search
CPC ..... B41J 2/0455; B41J 2/07; B41J 2/04541; B41J 2/04588; B41J 2/04543
(Continued)

(56) References Cited

U.S. PATENT DOCUMENTS 5,036,337 A 7/1991 Rezanka
5,541,629 A 7/1996 Saunders et al.
(Continued)

FOREIGN PATENT DOCUMENTS

CN 100483327 C 4/2009
CN 101868356 A 10/2010
(Continued)

OTHER PUBLICATIONS

Rice, H.W. "Next-generation Inkjet Printhead Drive Electronics" Jun. 1997.

*Primary Examiner* — An Do
(74) *Attorney, Agent, or Firm* — HP Inc.—Patent Department

(57) ABSTRACT

A printhead assembly includes ink ejection devices having nozzles and arranged into primitive groups, and processing electronics in communication with the ink ejection devices. The processing electronics including logic to receive data packets for controlling the ink ejection devices. Each data packet includes primitive firing data and fire signal selection data. The processing electronics also include logic to select, for each data packet, a fire signal for application to the primitive groups from among selectable fire signals switchable among the primitive groups based on the fire signal selection data in each respective packet. The processing electronics also include logic to generate the selected fire signals, and to apply the selected fire signals to the ink ejection devices based on the primitive firing data for each data packet.

20 Claims, 6 Drawing Sheets

(58) Field of Classification Search
USPC ..... 347/9–12
See application file for complete search history.

(56) References Cited

U.S. PATENT DOCUMENTS

| | | | |
|---|---|---|---|
| 6,386,674 | B1 | 5/2002 | Corrigan, III |
| 7,104,624 | B2 | 9/2006 | Schloeman et al. |
| 8,109,586 | B2 | 2/2012 | Benjamin |
| 2002/0186265 | A1 | 12/2002 | Schloeman |
| 2003/0081028 | A1 | 5/2003 | Feinn et al. |
| 2003/0081099 | A1 | 5/2003 | Wade |
| 2004/0095405 | A1 | 5/2004 | Schloeman |
| 2006/0092437 | A1 | 5/2006 | Martin |
| 2006/0268056 | A1 | 11/2006 | Molinet et al. |
| 2006/0274093 | A1 | 12/2006 | Kobayashi |

FOREIGN PATENT DOCUMENTS

| | | | |
|---|---|---|---|
| CN | 101898452 | A | 12/2010 |
| CN | 102107556 | A | 6/2011 |
| EP | 1128324 | | 8/2001 |
| EP | 1314562 | A2 | 5/2003 |
| WO | WO 2013-115804 | | 8/2013 |

PRINTHEAD FIRE SIGNAL CONTROL

BACKGROUND

Inkjet printheads typically receive electrical fire signals from a printing system controller to control the firing energy and properties of ink drops ejected from nozzles. For example, the fire signal properties may be used to determine the firing energy and properties of the ejected ink drops. In a typical inkjet printhead, ink nozzles having identical characteristics may be divided into primitive groups that require unique fire signals. For example, one primitive group may be for black nozzles and another primitive group may be for color nozzles. The black nozzles, for example, may require more fire signal energy than the color nozzles. In such a circumstance, the fire pulse controller provides one fire signal with higher energy for the black nozzle primitive group and another fire signal with lower energy for the color nozzle primitive group, but with all nozzles in each primitive group receiving the same fire signal. In some cases, however, not all nozzles in a primitive group may have identical characteristics, so that when the same fire signal is used for all nozzles in the primitive group, the fire signal is not optimal for all nozzles. Similarly, the characteristics of a nozzle may change over the course of a print job, such that when the same fire signal is used for all nozzles in the primitive group, the fire signal is not optimal for all nozzles. Some printing systems provide modifiable firing signals, but only during pauses between printed pages or after completed print jobs, and not intra-page. Consequently, control of printhead firing signals remains challenging and inefficient.

DETAILED DESCRIPTION OF EXAMPLES

Examples of printhead assemblies and printing systems having printhead fire signal control capabilities are disclosed herein. The term "primitive" as used herein refers to a grouping of ink ejection devices and their corresponding nozzles. The term "primitive group" as used herein refers to a grouping of primitives. In some instances it is desirable for nozzles within a primitive and corresponding primitive group to have different characteristics, such as ink color, drop weight, energy requirements, etc. Consequently not all nozzles within a primitive or the corresponding primitive group will be optimized for the same firing signal. For example, within a primitive group, some nozzles may be high drop weight nozzles and some nozzles may be low drop weight nozzles. If low drop weight nozzles are being fired (e.g., a group of low weight nozzles having the same nozzle address in a primitive group), one set of firing signal properties may be optimal. If high drop weight nozzles are being fired, another set of firing signal properties may be optimal. In another example, some devices grouped within a primitive may not actually drive nozzles. For example, they may control micro-recirculation pumps, warming circuits, etc., and may need fire signals with unique properties with respect to other devices in the primitive group.

Additionally, over the course of a print job, the energy requirements of a nozzle may change, and consequently the optimal firing signal properties for that nozzle may change. For example, if a nozzle has not been fired for an extended period of time, settling of colorant in the ink chamber or ink crusting may occur, in which case a higher energy fire signal may be required. At other times, in order to service nozzles, multiple drivers (e.g., FETs or other devices) may be configured to drive a nozzle in parallel. In this configuration, the optimal fire signal properties may differ from those for other nozzles in the same primitive group. The example printhead assemblies and printing systems disclosed herein may provide fire signal control during print jobs (i.e., intra-page while the printing system is actively printing as opposed to during pauses between pages or after a completed print job), and may enable optimized fire signals for nozzles and devices having differing characteristics within the same primitive group.

Figure 1:
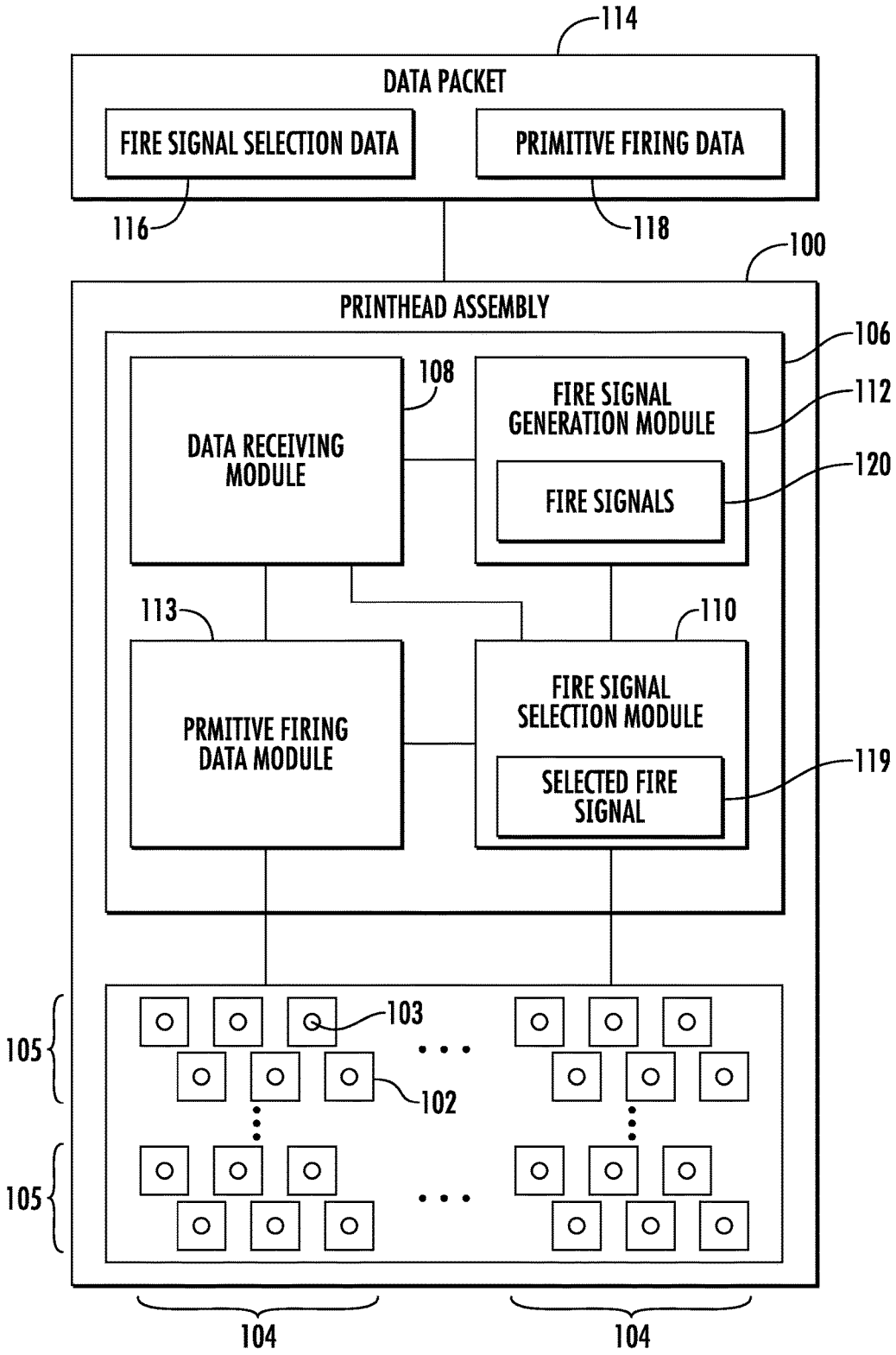
FIG. 1 is a schematic illustration of an example printhead assembly having firing pulse control capabilities.

FIG. 1 schematically illustrates an example printhead assembly 100. As will be described hereafter, printhead assembly 100 includes fire signal control capabilities. Printhead assembly 100 may be, for example, a thermal or piezoelectric inkjet printhead for use in commercial inkjet printers, such as inkjet printers manufactured by Hewlett Packard Company, assignee of the present application. Printhead assembly 100 may be used in other types of printers as well. In general, printhead assembly 100 may receive data packets from a printing system that instruct printhead assembly 100 to eject droplets of ink onto a print medium by firing nozzles within an array of ink ejection devices in a particular sequence (i.e., by energizing the ink ejection devices with electrical signals). Printhead assembly 100 may further receive data from the printing system that enables printhead assembly 100 to provide fire signal control during print jobs and to enable optimized fire signals for nozzles and devices having differing characteristics within the same primitive group.

In some examples, printhead assembly 100 may include an electrical interface for connection to a printing system, and a fluid interface for connection to an ink reservoir that supplies ink (e.g., black, red, blue, yellow, etc.) to printhead assembly 100. In some examples, the fluid interface and ink reservoir may supply a single color of ink, while in other examples, the fluid interface and ink reservoir may supply multiple colors of ink. In some examples, printhead assembly 100 may be housed within an inkjet cartridge along with the ink reservoir, while in other examples, the ink reservoir may be a separate component, such as a component of the printing system. In some examples, printhead assembly 100 may be coupled to or supported by an interface included in a printing system, such as an inkjet printing system. The printing system interface may provide electrical and fluidic connections to printhead assembly 100. The printing system interface may also provide mechanical structure for positioning printhead assembly 100 relative to a print media transport assembly of the printing system so that printhead assembly 100 may eject drops of ink toward print media (e.g., paper, cardstock, etc.) to print, for example, characters, lines, shapes, symbols, images on the print media (e.g., black and white, grayscale, color, etc.) upon receiving nozzle data from the printing system.

As illustrated in FIG. 1, printhead assembly 100 may include ink ejection devices 102 having nozzles 103. In some examples, ink ejection devices 102 may be constructed in arrays on a silicon wafer or other suitable material using, for example, a photolithographic process that uses a combination of masking, depositing, and etching steps in order to form electrical circuits, fluidic channels, and other structures that make up ink ejection devices 102. For example, an ink ejection device 102 may include a firing resistor and a vaporization chamber in addition to a nozzle 103. An array of ink ejection devices 102 may include columns of ink ejection devices 102 in communication with an ink feed slot. Individual print die having an array of ink ejection devices 102 may then be separated from the other die on the silicon wafer. Other manufacturing processes may be used as well to create ink ejection devices 102. Printhead assembly 100 may also include a die carrier. The die carrier may provide the electrical and fluidic connections described above between printhead assembly 100 and, for example, a commercial inkjet printing system. The die carrier may also provide structural support for print die including ink ejection devices 102. For example, print die may be partially inserted into and seated within a cavity of the die carrier such that the die are generally held in position, with portions of the print die extending outward from the die carrier such that nozzles 103 are exposed. Printhead assembly 100 may contain any suitable number of ink ejection devices 102, as well as any suitable number of corresponding print dies and die carriers.

Figure 2:
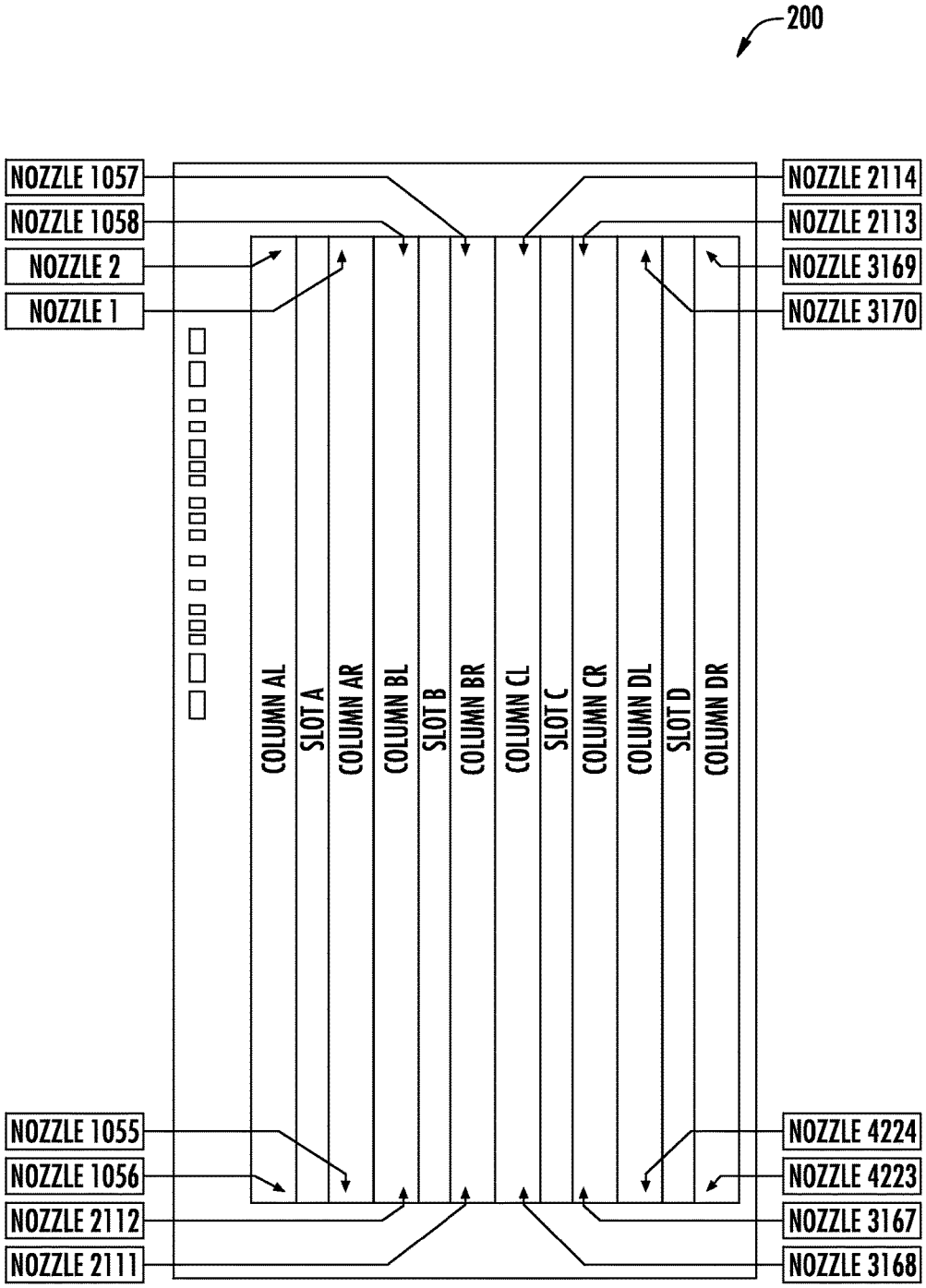
FIG. 2 is a diagram illustrating an example array of nozzles organized into primitive groups that may be utilized in the printhead assembly of FIG. 1.

An array of ink ejection devices 102 and their corresponding nozzles 103 may be arranged into primitives 104 and primitive groups 105 with respect to, for example, ink feed slots. For example, FIG. 2 is a diagram illustrating an example array of nozzles organized into primitive groups that may be utilized in printhead assembly 100. As shown in FIG. 2, nozzles 1-4224 may be arranged into 8 nozzle columns: AL, AR, BL, BR, CL, CR, DL, and DR (for illustration purposes, only the first nozzle and the last nozzle in each column are shown). Each of nozzle columns AL-DR may be a similarly numbered primitive group, such that there may be a total of 8 primitive groups AL-DR. While the nozzles in primitive groups AL-DR are shown as being grouped in to columns, other arrangements are contemplated as well.

Primitive groups AL-DR may be aligned with respect to ink feed slots A, B, C, and D. For example, as shown in FIG. 2, primitive groups AL-DR may include columns of nozzles positioned adjacent to and parallel with ink feed slots A, B, C, and D. Primitive groups AL-DR may be respectively aligned to the left and right of ink feed slot A, primitive groups BL and BR may be respectively aligned to the left and right of ink feed slot B, primitive groups CL and CR may be respectively aligned to the left and right of ink feed slot C, and primitive groups DL and DR may be respectively aligned to the left and right of column D. As shown in FIG. 2, primitive groups AL-DR may each include 528 nozzles. Each pair of primitive groups aligned to the left and right of their respective ink feed slot (e.g., primitive groups AL and AR with respect to ink feed slot A, primitive groups BL-BR with respect to column B, etc.) may each include 1056 nozzles, with even numbered nozzles in the left primitive groups and odd numbered nozzles in the right primitive groups (e.g., even numbered nozzles 2-1056 may be included in primitive groups AL, and odd numbered nozzles 1-1055 may be included in primitive groups AR, even numbered nozzles 1058-2112 may be included in primitive groups BL, etc.).

Other arrangements and schemes for primitive groups are contemplated as well. For example, nozzle columns AL and AR may be combined to form a single primitive group aligned with ink feed slot A, nozzle columns BL and BR may be combined to form a single primitive group aligned with ink feed slot B, and so on such that nozzle columns AL, AR, BL, BR, CL, CR, DL, and DR may be arranged into 4 primitive groups with respect to ink feed slots A-D. This may be the case where, for example ink feed slots A-D may each be dedicated to a particular color of ink such that the left and right nozzle columns adjacent to each ink feed slot are supplied with ink of that particular color (e.g., nozzle columns AL and AR are supplied with blue ink from ink feed slot A, nozzle columns BL and BR are supplied with red ink from ink feed slot B, etc.).

Figure 3:
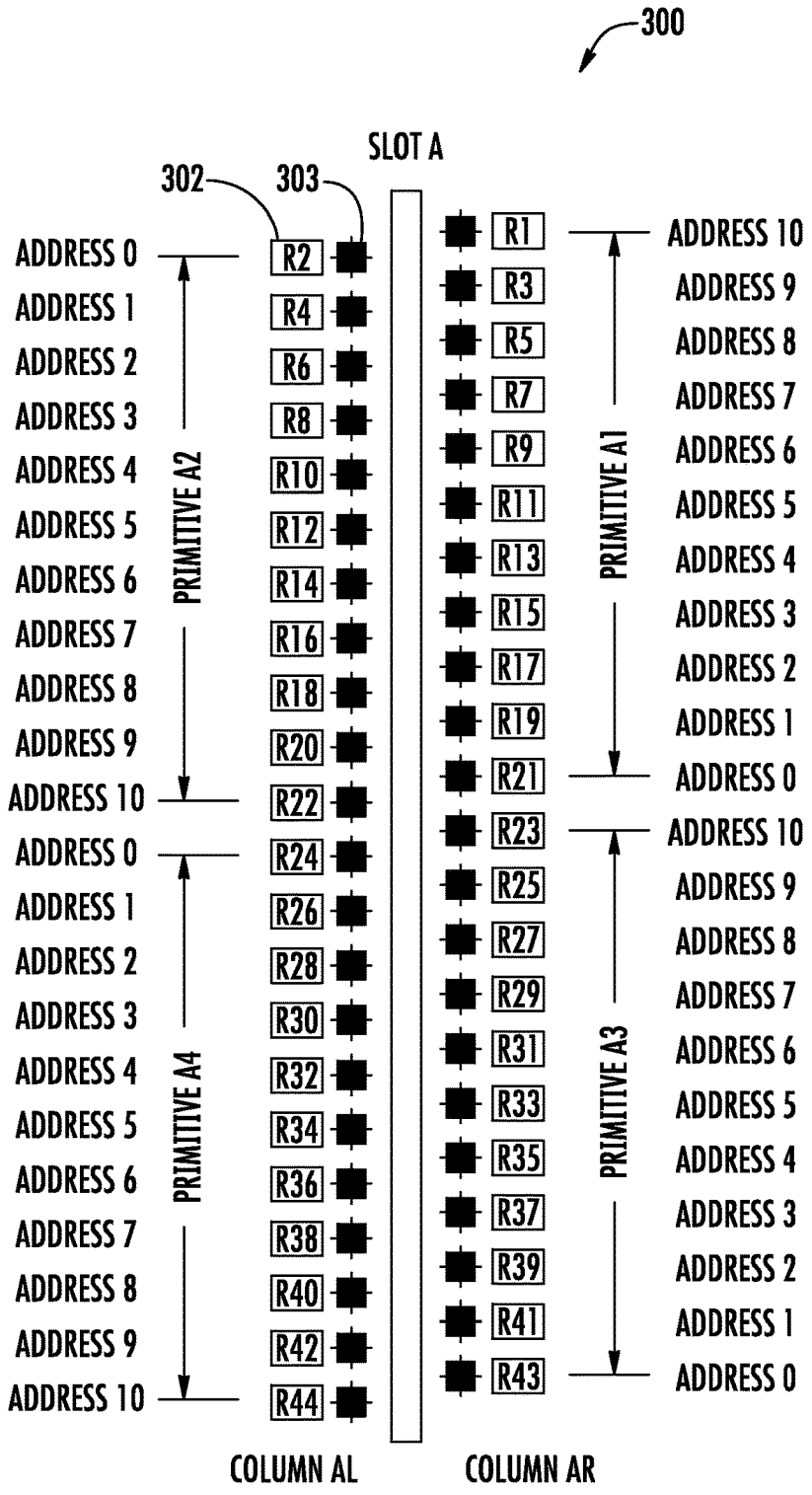
FIG. 3 is a diagram illustrating an example array of ink ejection devices and their corresponding nozzles organized into primitives that may be included in the printhead assembly of FIG. 1.

Referring again to FIG. 1, each primitive group 105 may be divided into primitives 104, each primitive 104 having a particular number of ink ejection devices 102 and corresponding nozzles 103. The number of ink ejection devices 102 and their corresponding nozzles 103 may vary for each primitive 104. In some examples, the same number of ink ejection devices 102 and their corresponding nozzles 103 are included in each primitive 104. Similarly, the number of primitives 104 in each primitive group 105 may vary, or may be the same. For example, FIG. 3 is a diagram illustrating an example array 300 of ink ejection devices 302 and their corresponding nozzles 303 organized into primitives that may be included in printhead assembly 100. Nozzles 303 in FIG. 3 may be, for example, representative of nozzles 1-44 shown in FIG. 2. As shown in FIG. 3, ink ejection devices 302 and their corresponding nozzles 303 may be aligned into columns AL and AR with respect to ink feed slot A. Columns AL and AR may each form a respective primitive group AL and AR. Ink ejection devices 302 and their corresponding nozzles 303 may also be grouped into primitives A1, A2, A3, and A4. Primitive group AL may include primitives A2 and A4. Primitive group AR may include primitives A1 and A3. Each of primitives A1, A2, A3, and A4 may include 11 nozzles (e.g., odd numbered nozzles 1-11 in primitive A1, even numbered nozzles 2-22 in primitive A2, etc.).

Each nozzle within a primitive may be assigned an address. For example, as shown in FIG. 3, each nozzle in primitives A1, A2, A3, and A4 may be assigned an address ranging from Address 0 to Address 10. The address scheme for each primitive may be the same, or may vary for each primitive. Any suitable address scheme may be used. For example, as shown in FIG. 3, in primitive group AL, the nozzles in each of primitive groups A2 and A4 may be addressed consecutively from top to bottom as: Address 0, Address 1, Address 2, Address 3, Address 4, Address 5, Address 6, Address 7, Address 8, Address 9, and address 10. The nozzles in each of primitive groups A1 and A3 may be addressed consecutively from top to bottom as: Address 10, Address 9, Address 8, Address 7, Address 6, Address 5, Address 4, Address 3, Address 2, Address 1, and Address 0.

In some examples, during a firing sequence, the corresponding ink ejection device 102 for only one nozzle 103 per each primitive 104 may be fired at any given time. This may be, for example, to manage peak energy demands. In some examples, during a firing sequence, all primitives 104 within a primitive group 105 may use the same address data (e.g., a single nozzle 103 in each primitive 104 of a primitive group 105 may be fired at a given time, and all nozzles 103 in a primitive group 105 fired at that given time have the same address within their respective primitives 104. For example, with respect to FIG. 3, primitives A1, A2, A3, and A4 may each share the same address data so that only one nozzle per each primitive 104 is fired at a time, based on of addresses 0-10 (e.g., all nozzles at Address 6 fire at the same time, etc.).

Referring again to FIG. 1, in some examples, all ink ejection devices 102 and their corresponding nozzles 103 in a particular primitive 104 and/or primitive group 105 may have the same characteristics. For example, nozzles 103 may all be black ink nozzles, all color ink nozzles, all low drop weight nozzles, all high drop weight nozzles, nozzles all having the same energy requirements, etc. In some examples, ink ejection devices 102 and their corresponding nozzles 103 in a particular primitive 104 and/or primitive group 105 may have differing characteristics. For example, some nozzles 103 may be black ink nozzles and some may be color ink nozzles, some may be high drop weight nozzles and some may be low drop weight nozzles. Similarly, ink ejection devices 102 and their corresponding nozzles 103 in a particular primitive 104 and/or primitive group 105 may have varying energy requirements (e.g., varying fire signal properties such as, for example, pulse width, pulse amplitude, duty cycle, number of pulses, slew rate of edges in pulse transitions, etc.). In some examples, devices other than ink ejection devices 102 may be included in a particular primitive 104 and/or primitive group 105 (e.g., micro-recirculation pumps, warming circuits, etc.) along with ink ejection devices 102. In some examples, the energy requirements of ink ejection devices 102 and their corresponding nozzles 103 within a primitive 104 and/or primitive group 105 may change such that they differ from other ink ejection devices 102 and their corresponding nozzles 103 in the same primitive 104 and/or primitive group 105. For example, if an ink ejection device 102 and its corresponding nozzle 103 has not been fired for an extended period of time, settling of colorant in the ink chamber or ink crusting may occur, in which case a higher energy fire signal may be required. At other times, in order to service an ink ejection device 102 and its corresponding nozzle 103, multiple drivers (e.g., FETs or other devices) may be configured to drive ink ejection device 102 and its corresponding nozzle 103 in parallel. In this configuration, the optimal fire signal properties may differ from those for other nozzles 103 in the same primitive 104 and/or primitive group 105.

Printhead assembly 100 may also include processing electronics 106. Processing electronics 106 may include, for example, a processing unit configured to execute logic in the form of software instruction modules contained in a memory. For purposes of this application, the term "processing unit" shall mean a presently developed or future developed processing unit that executes sequences of instructions contained in a memory. In general, upon executing instructions contained in the memory, the processing unit may provide fire signal control capability in printhead assembly 100. The instructions may be loaded in a random access memory (RAM) for execution by the processing unit from a read only memory (ROM), a mass storage device, or some other persistent storage. In some examples, hardwired circuitry modules may be used in place of or in combination with software instruction modules in processing electronics 106 to implement the functionality described herein. For example, the fire signal control functionality of printhead assembly 100 may be implemented entirely or in part by logic contained in an application-specific integrated circuit (ASIC). Unless otherwise specifically noted, processing electronics 106 is not limited to any specific combination of hardware circuitry modules and software instruction modules, nor to any particular source for the instructions executed by the processing unit.

Memory may include a non-transitory computer-readable medium. The term "non-transitory computer-readable medium" as used herein includes any computer readable medium, excluding only transitory propagating signals per se. Memory may include, for example any non-volatile or volatile memory such as DRAM, RAM, ROM, register memory, or some combination of these; for example a hard disk combined with RAM. Memory may store instructions for execution by a processing unit. In some examples, memory may further store data for use by a processing unit. Memory may store various software or code modules that direct a processing unit to carry out various interrelated actions.

Figure 4:
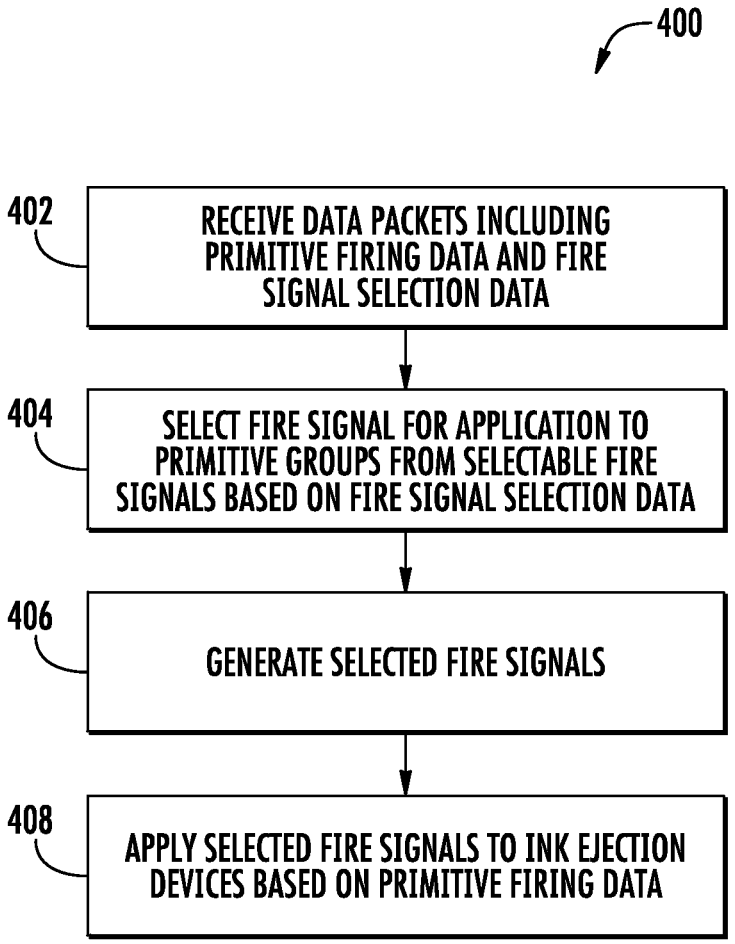
FIG. 4 is a flow diagram of an example process that may be carried out by the printhead assembly of FIG. 1.

As shown in FIG. 1, processing electronics 106 may include data receiving module 108, fire signal selection module 110, fire signal generation module 112, and primitive firing data module 113. Modules 108, 110, 112, and 113 may cooperate to cause processing electronics 106 to carry out the process 500 set forth by the flow diagram of FIG. 4. As indicated by a step 402, data receiving module 108 may receive data packets 114 for controlling ink ejection devices 102. Data packets 114 may be received from, for example, a printing system in communication with printhead assembly 100. Data packet 114 may be one of several data packets 114 sent from the printing system in order to execute a firing sequence for a particular print job being printed by the printing system. In some examples, a separate data packet may be received by data receiving module 108 for each firing in a firing sequence.

Data packet 114 may include, for example, primitive fire signal selection data 116 and primitive firing data 118. For example, data packet 114 may include start bits that may be used by data receiving module 108 to recognize the start of data packet 114. The start bits may also include fire signal selection data 116. The start bits may then be followed by primitive firing data 118, and stop bits indicating the end of data packet 114. Other suitable data ordering, sequences, and additional data types within data packet 114 are contemplated as well.

In some examples, data packet 114 may also include nozzle address data 114 (e.g., after fire signal selection data 116 and before primitive firing data 118). In some examples, processing electronics 106 may separately generate nozzle address data such that it need not be included in data packet 114. Nozzle address data as used herein refers to data containing the address of a particular ink ejection device 102 and its corresponding nozzle 103, or another type of device in a primitive 104 to receive primitive firing data from each nozzle packet 114. In some examples, all primitives 104 within a primitive group 105 may use the same address data. For example, referring again to FIG. 3, primitives A2 and A4 in the primitive group corresponding to column AL may use the same address data. In some examples, all devices sharing the same address data have the same device characteristics (e.g., all black ink nozzles, all color ink nozzles, all low drop weight nozzles, all high drop weight nozzles, etc.).

The term fire signal selection data as used herein refers to data indicating a fire signal to be applied to ink ejection devices 102 or other devices in primitives 104 and/or primitive groups 105. The fire signal to be applied to ink ejection devices 102 or other devices in primitives 104 and/or primitive groups 105 may depend on, for example, the characteristics of the ink ejection devices 102 and their corresponding nozzles 103 in primitives 104 and/or primitive groups 105. In some examples, all ink ejection devices 102 and their corresponding nozzles 103 in a particular primitive 104 and/or primitive group 105 may have the same characteristics (e.g., all black ink nozzles, all color ink nozzles, all low drop weight nozzles, all high drop weight nozzles, etc.). In such examples, the fire signal to be applied may remain the same with respect to the corresponding primitive 104 and/or primitive group 105 for all data packets 114.

In some examples, all ink ejection devices 102 and their corresponding nozzles 103 in a particular primitive 104 and/or primitive group 105 may have the same characteristics. For example, nozzles 103 may all be black ink nozzles, all color ink nozzles, all low drop weight nozzles, all high drop weight nozzles, nozzles all having the same energy requirements, etc. In some examples, ink ejection devices 102 and their corresponding nozzles 103 in a particular primitive 104 and/or primitive group 105 may have differing characteristics. For example, some nozzles 103 may be black ink nozzles and some may be color ink nozzles, some may be high drop weight nozzles and some may be low drop weight nozzles. Similarly, ink ejection devices 102 and their corresponding nozzles 103 in a particular primitive 104 and/or primitive group 105 may have varying energy requirements (e.g., varying fire signal properties such as, for example, pulse width, pulse amplitude, duty cycle, number of pulses, slew rate of edges in pulse transitions, etc.). In some examples, devices other than ink ejection devices 102 may be included in a particular primitive 104 and/or primitive group 105 (e.g., micro-recirculation pumps, warming circuits, etc.) along with ink ejection devices 102. In some examples, the energy requirements of ink ejection devices 102 and their corresponding nozzles 103 within a primitive 104 and/or primitive group 105 may change such that they differ from other ink ejection devices 102 and their corresponding nozzles 103 in the same primitive 104 and/or primitive group 105. For example, if an ink ejection device 102 and its corresponding nozzle 103 has not been fired for an extended period of time, settling of colorant in the ink chamber or ink crusting may occur, in which case a higher energy fire signal may be required. At other times, in order to service an ink ejection device 102 and its corresponding nozzle 103, multiple drivers (e.g., FETs or other devices) may be configured to drive ink ejection device 102 and its corresponding nozzle 103 in parallel. In this configuration, the optimal fire signal properties may differ from those for other nozzles 103 in the same primitive 104 and/or primitive group 105. In examples such as these, the fire signal to be applied to ink ejection devices 102 and their corresponding nozzles 103, or other devices in a particular primitive 104 and/or primitive group 105 may need to vary for some data packets 114 depending on the particular device being controlled. Fire signal selection data 116 may indicate a fire signal to be applied to ink ejection devices 102 or other devices in primitives 104 and/or primitive groups 105, and may vary among data packets 114 depending on characteristics of the particular device being controlled.

The term primitive firing data as used herein refers to data indicating that a firing should or should not occur for a particular ink ejection device 102 and corresponding nozzle 103 or other device in a particular primitive 104 and/or primitive group 105 as identified by corresponding nozzle address data. For a particular print job firing sequence, data receiving module 108 may receive a data packet 114 including unique primitive firing data 118 for each primitive 104 in primitive groups 105. Unique primitive firing data 118 may indicate that ink ejection devices 102 and their corresponding nozzles 103 or other devices in some of the primitives 104 should fire while others should not. For example, as described above, nozzle address data (e.g., received in data packet 114 or generated by printhead assembly 100) may indicate the address of a particular ink ejection device 102 and its corresponding nozzle 103, or another type of device in a primitive 104 to receive primitive firing data 118 from nozzle packet 114 (e.g., Address 8 shown in FIG. 3). Further, all primitives 104 within primitive groups 105 may use the same address data (e.g., primitives A1-A4 shown in FIG. 3), and all devices sharing the same address data have the same device characteristics (e.g., all nozzles at Address 8 are high drop weight nozzles). Unique primitive firing data 118 from nozzle packet 114 may be sent to all primitives 104 (e.g., to devices at Address 8 in primitives A1-A4 shown in FIG. 3). The unique primitive firing data 118 may indicate that a firing should occur for some or all devices (e.g., primitive firing data sent to primitives A2 and A4 may indicate that a firing should occur, while the primitive firing data sent to primitives A1 and A3 may indicate that a firing should not occur.).

As indicated by a step 404, fire signal selection module 110 may select a fire signal 119 for application to primitive groups 105 based on fire signal selection data 116 in data packet 114. For example, fire signal 119 may be selected from among selectable fire signals 120 sent from fire signal generation module 112 to fire signal selection module 110. Fire signals 120 may be switchable among primitive groups 105 such that any one of fire signals 120 may be applied to each of primitive groups 105 for a given data packet 114 as indicated by fire signal selection data 116 included therein. For example, a given data packet 114 received by data receiving module 108 may include primitive firing data 118 for high drop weight nozzles in all primitives 104 and corresponding primitive groups 105 (e.g., primitive firing data 118 may be routed to all primitives 104 in primitive groups 105, and in particular to all ink ejection devices 102 and their corresponding nozzles 103 at the same address within each primitive 104, where all such devices have high drop weight nozzles). Fire signal selection data 116 in data packet 114 may correspondingly indicate a fire signal 119 having properties optimized for high drop weight nozzles should be applied to primitive groups 105. Fire signal selection module 110 may accordingly select fire signal 119 from selectable fire signals 120 and allow fire signal 119 to be switched to each of primitive groups 105. Similarly, the next data packet 114 received by data receiving module 108 may include primitive firing data 118 for low drop weight nozzles in all primitives 104 and corresponding primitive groups 105 (e.g., primitive firing data 118 may be routed to all primitives 104 in primitive groups 105, and in particular to all ink ejection devices 102 and their corresponding nozzles 103 at the same address within each primitive 104, where all such devices have low drop weight nozzles). Fire signal selection data 116 in data packet 114 may correspondingly indicate a fire signal 119 having properties optimized for low drop weight nozzles should be applied to primitive groups 105. Fire signal selection module 110 may accordingly select fire signal 119 from selectable fire signals 120 and allow fire signal 119 to be switched to each of primitive groups 105.

In some examples, fire signal selection module 110 may include multiplexors in communication with data receiving module 108 such that fire signal selection data 116 may be sent to the multiplexors. The multiplexors may be in communication with primitive groups 105 (e.g., one multiplexor for each primitive group) so that the multiplexors may select fire signal 119 for application to the primitive groups 105 from among the selectable fire signals 120 sent to fire signal selection module 110 based on fire signal selection data 116. Other configurations utilizing additional or fewer multiplexors, or utilizing other types of routing or switching devices are contemplated as well.

As indicated by a step 406, fire signal generation module 112 may generate the selected fire signal 119. In some examples, fire signal generation module 112 may generate multiple fire signals 120 and send them to fire signal selection module 110 for selection of fire signal 119 for application to the primitive groups 105. Fire signals 120 may have different properties that may determine the firing energy and properties of the ink drop ejected from a particular ink ejection device 102 and corresponding nozzle 103 in a primitive. Such fire signal properties may include, for example, pulse width, pulse amplitude, duty cycle, number of pulses, slew rate of edges in pulse transitions, etc. In some examples, fire signals 120 may include signals optimized for, for example, high drop weight nozzles, low drop weight nozzles, black ink nozzles, color ink nozzles, etc. In some examples, fire signals 120 may include signals optimized for devices that may not actually drive nozzles. For example, fire signals 120 may include signals optimized to control micro-recirculation pumps, warming circuits, etc. In some examples, fire signals 120 may include signals optimized for the energy requirements of a nozzle 103 that may have changed over time during a print job. For example, if an ink ejecting device 102 and its corresponding nozzle 103 has not been fired for an extended period of time, settling of colorant in the ink chamber or ink crusting may occur, in which case a higher energy fire signal 120 may be required. At other times, in order to service nozzles 103, multiple drivers (e.g., FETs or other devices) may be configured to drive nozzle 103 in parallel. Optimal fire signals for these situations and configuration may be included in fire signals 120. Other types of fire signals 120 are contemplated as well.

As indicated by a step 408, primitive firing data module 113 may apply the selected fire signal 119 to ink ejection devices 102 or other devices based on primitive firing data 118 for each data packet 114. In some examples, a particular ink ejection device 102 and its corresponding nozzle 103, or other device in a primitive 104 fires when primitive firing data module 113 receives (a) address data that matches the address of the particular ink ejection device 102 and its corresponding nozzle 103, or other device in the primitive, (b) primitive firing data 118 that indicates a firing should occur in primitive 104, and (c) selected fire signal 119.

As will be appreciated, including fire signal selection data in each data packet allows fire signal control to be implemented in a printhead assembly on a per packet basis and at a high data rate during printing of a print job by a printing system. In some examples, data packets may have an associated period of approximately 2 microseconds. As will also be appreciated, including fire signal selection data in each data packet allows for optimized fire signals for multiple device types included in a primitive group. For example, columns of ink ejection devices having multiple ink drop weights may be implemented with optimized performance. As will further be appreciated, functions such as micro-recirculation and energy optimization for devices with characteristics that may change over time may be implemented.

Figure 5:
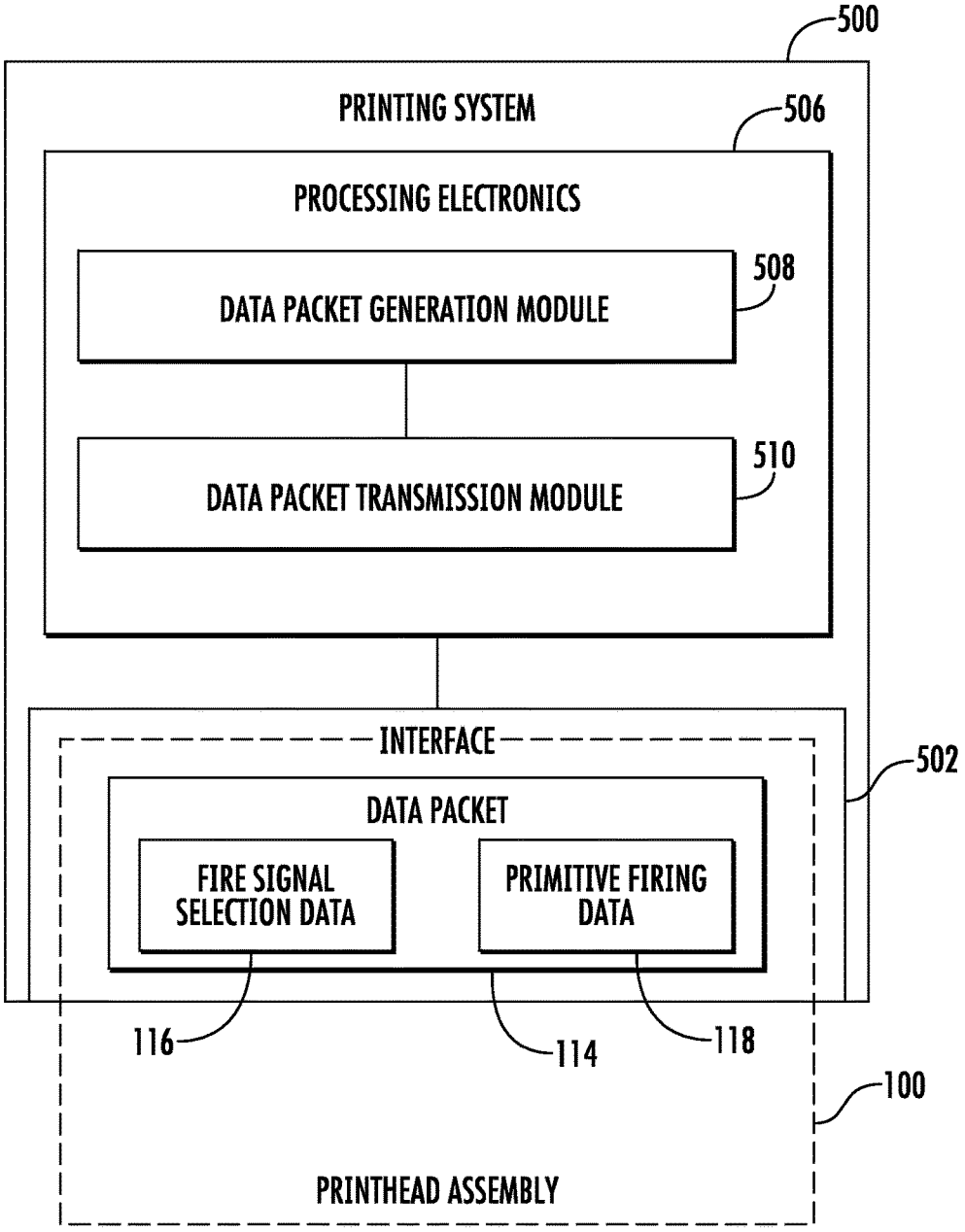
FIG. 5 is a schematic illustration of an example printing system for use with the printhead assembly of FIG. 1 to detect and respond to data errors.

FIG. 5 is a schematic illustration of an example printing system 500 for use with printhead assembly 100. As will be described hereafter, printing system 500 may include fire signal control capabilities. Printing system 500 may be, for example, a commercial inkjet printer, such as an inkjet printer manufactured by Hewlett Packard Company, assignee of the present application. Printing system 500 may be other types of printers as well. Printing system 500 may utilize any suitable number of printhead assemblies 100 depending on the particular printing application. In general, printing system 500 may transmit data packets 114 to printhead assembly 100 that instruct printhead assembly 100 to eject droplets of ink onto a print medium by firing nozzles within an array of ink ejection devices in a particular sequence (i.e., by energizing the ink ejection devices with electrical signals). Printing system 500 may further transmit data to printhead assembly 100 that enables printhead assembly 100 to provide fire signal control during print jobs and to enable optimized fire signals for nozzles and devices having differing characteristics within the same primitive group 105.

Printing system 500 may include an interface 502. Interface 502 may include an electrical interface for connection to printhead assembly 100. In some examples, printing system 500 may include a relatively higher frequency data channel, such as a Low Voltage Differential Signaling (LVDS) data bus, which may be a uni-directional data bus for transmitting data packets 114 to printhead assembly 100 at higher data rates required during print jobs. Interface 502 may also include a relatively lower frequency data channel, such as a Command Status Input/Output (CSIO) data channel, which may be a bi-directional data channel used to, for example, configure thermal controls, firing parameters of selectable firing signals 120, and monitor fault data for printhead assembly 100 using a lower data rate. CSIO data transmissions may be initiated by printing system 500, and may include memory addresses in processing electronics 106 to be written to and read from, as well as any data to be written. Printing system 500 may then receive an echo from processing electronics 106 of printhead assembly 100 indicating the memory locations written to and read from, the data written and read, and any fault indicators. In some examples, printing system 500 may include an LVDS data bus, which may be a bi-directional data bus.

In some examples, interface 502 may include a fluid interface for supplying ink (e.g., black, red, blue, yellow, etc.) to printhead assembly 100 from an ink reservoir included in printing system 500. In some examples, the fluid interface and ink reservoir may supply a single color of ink, while in other examples, the fluid interface and ink reservoir may supply multiple colors of ink. In some examples, interface 502 may be coupled to printhead assembly 100, provide support for printhead assembly 100, or otherwise provide mechanical structure for positioning printhead assembly 100 relative to a print media transport assembly of printing system 500 so that printhead assembly 100 may eject drops of ink toward print media (e.g., paper, cardstock, etc.) to print, for example, characters, lines, shapes, symbols, images on the print media (e.g., black and white, grayscale, color, etc.) upon receiving nozzle data from printing system 500.

Printing system 500 may also include processing electronics 506. Processing electronics 506 may include, for example, a processing unit configured to execute logic in the form of software instruction modules contained in a memory. In general, upon executing instructions contained in the memory, the processing unit may provide fire signal control capability in printing system 500. The instructions may be loaded in a random access memory (RAM) for execution by the processing unit from a read only memory (ROM), a mass storage device, or some other persistent storage. In some examples, hardwired circuitry modules may be used in place of or in combination with software instruction modules in processing electronics 506 to implement the functionality described herein. For example, fire signal control functionality of printing system 500 may be implemented entirely or in part by logic contained in an ASIC. Unless otherwise specifically noted, processing electronics 506 is not limited to any specific combination of hardware circuitry modules and software instruction modules, nor to any particular source for the instructions executed by the processing unit.

Memory may include a non-transitory computer-readable medium. The term "non-transitory computer-readable medium" as used herein includes any computer readable medium, excluding only transitory propagating signals per se. Memory may include, for example any non-volatile or volatile memory such as DRAM, RAM, ROM, register memory, or some combination of these; for example a hard disk combined with RAM. Memory may store instructions for execution by a processing unit. In some examples, memory may further store data for use by a processing unit. Memory may store various software or code modules that direct a processing unit to carry out various interrelated actions.

Figure 6:
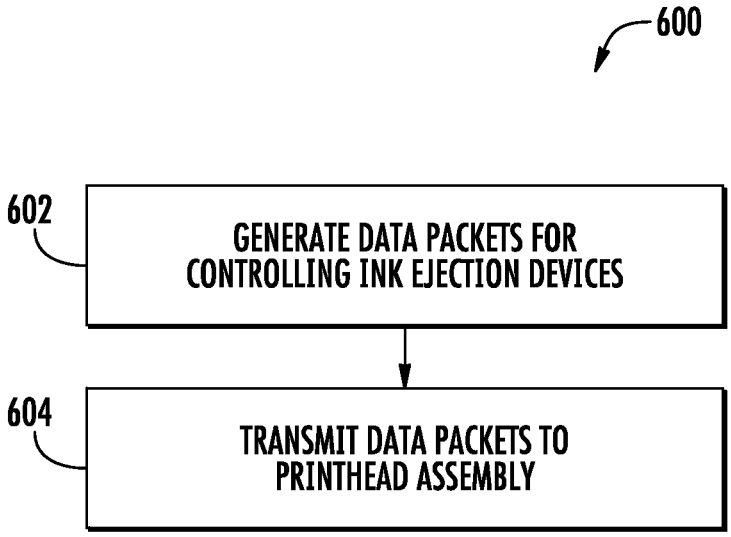
FIG. 6 is a flow diagram of an example process that may be carried out by the printing system of FIG. 5.

As shown in FIG. 5, processing electronics 506 may include data packet generation module 508 and data packet transmission module 510. Modules 508 and 510 may cooperate to cause processing electronics 506 to carry out the process 600 set forth by the flow diagram of FIG. 6. As indicated by a step 602, data packet generation module 508 may generate data packets 114 for controlling ink ejection devices 102. Data packets 114 may be generated for, for example, a printhead assembly 100 in communication with printing system 500. As described above, data packet 114 may be one of several data packets 114 sent from printing system 500 to printhead assembly 100 in order to execute a firing sequence for a particular print job being printed by printing system 500. In some examples, a separate data packet 114 may be generated by data packet generation module 508 for each firing in a firing sequence.

Data packet 114 may include, for example, primitive fire signal selection data 116 and primitive firing data 118. For example, data packet 114 may include start bits that may be used by data receiving module 108 to recognize the start of data packet 114. The start bits may also include fire signal selection data 116. The start bits may then be followed by primitive firing data 118, and stop bits indicating the end of data packet 114.

In some examples, data packet 114 may also include nozzle address data 114 (e.g., after fire signal selection data 116 and before primitive firing data 118). In some examples, processing electronics 106 of printhead assembly 100 may separately generate nozzle address data such that it need not be included in data packet 114. In some examples, all primitives 104 within a primitive group 105 may use the same address data. In some examples, all devices sharing the same address data have the same device characteristics (e.g., all black ink nozzles, all color ink nozzles, all low drop weight nozzles, all high drop weight nozzles, etc.).

As described above, fire signal selection data 116 may indicate a fire signal 119 for application to primitive groups 105 from among selectable fire signals 120. Selectable fire signals 120 may be switchable among primitive groups 105 at printhead assembly 100 based on fire signal selection data 116 in each respective data packet 114. The fire signal selection data 116 in each data packet 114 may be generated by data packet generation module 508 based on, for example, differing characteristics of devices within one of the primitive groups 105.

By way of example, ink ejection devices 102 and their corresponding nozzles 103 in a particular primitive 104 and/or primitive group 105 may have differing characteristics. For example, some nozzles 103 may be black ink nozzles and some may be color ink nozzles, some may be high drop weight nozzles and some may be low drop weight nozzles. Similarly, ink ejection devices 102 and their corresponding nozzles 103 in a particular primitive 104 and/or primitive group 105 may have varying energy requirements (e.g., varying fire signal properties such as, for example, pulse width, pulse amplitude, duty cycle, number of pulses, slew rate of edges in pulse transitions, etc.). In some examples, devices other than ink ejection devices 102 may be included in a particular primitive 104 and/or primitive group 105 (e.g., micro-recirculation pumps, warming circuits, etc.) along with ink ejection devices 102. In some examples, the energy requirements of ink ejection devices 102 and their corresponding nozzles 103 within a primitive 104 and/or primitive group 105 may change such that they differ from other ink ejection devices 102 and their corresponding nozzles 103 in the same primitive 104 and/or primitive group 105. For example, if an ink ejection device 102 and its corresponding nozzle 103 has not been fired for an extended period of time, settling of colorant in the ink chamber or ink crusting may occur, in which case a higher energy fire signal may be required. At other times, in order to service an ink ejection device 102 and its corresponding nozzle 103, multiple drivers (e.g., FETs or other devices) may be configured to drive ink ejection device 102 and its corresponding nozzle 103 in parallel. In this configuration, the optimal fire signal properties may differ from those for other nozzles 103 in the same primitive 104 and/or primitive group 105. In examples such as these, the fire signal to be applied to ink ejection devices 102 and their corresponding nozzles 103, or other devices in a particular primitive 104 and/or primitive group 105 may need to vary for some data packets 114 depending on the particular device being controlled.

Fire signal selection data 116 generated by data packet generation module 508 may indicate a fire signal 119 to be applied to ink ejection devices 102 or other devices in primitives 104 and/or primitive groups 105, and may vary among data packets 114 depending on characteristics of the particular device being controlled. In some examples, fire signal selection data 116 may be used to select among multiple fire signals 120 having different properties that may determine the firing energy and properties of the ink drop ejected from a particular ink ejection device 102 and corresponding nozzle 103 in a primitive. Such fire signal properties may include, for example, pulse width, pulse amplitude, duty cycle, number of pulses, slew rate of edges in pulse transitions, etc. In some examples, fire signals 120 may include signals optimized for, for example, high drop weight nozzles, low drop weight nozzles, black ink nozzles, color ink nozzles, etc. In some examples, fire signals 120 may include signals optimized for that may not actually drive nozzles. For example, fire signals 120 may include signals optimized to control micro-recirculation pumps, warming circuits, etc. In some examples, fire signals 120 may include signals optimized for the energy requirements of a nozzle 103 that may have changed over time during a print job. For example, if an ink ejecting device 102 and its corresponding nozzle 103 has not been fired for an extended period of time, settling of colorant in the ink chamber or ink crusting may occur, in which case a higher energy fire signal 120 may be required. At other times, in order to service nozzles 103, multiple drivers (e.g., FETs or other devices) may be configured to drive nozzle 103 in parallel. Optimal fire signals for these situations and configuration may be included in fire signals 120. Other types of fire signals 120 are contemplated as well.

As indicated by a step 604, data packet transmission module 510 may transmit data packets 114 to the printhead assembly via interface 502. In some examples, printing system 500 may include a relatively higher frequency data channel, such as a Low Voltage Differential Signaling (LVDS) data bus, which may be a uni-directional data bus for transmitting data packets 114 to printhead assembly 100 at higher data rates required during print jobs. Data packet transmission module 510 may utilize the LVDS bus to transmit data packets 114 to printhead assembly 100 at a high data rate during printing of a print job by printing system 500.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printhead assembly, comprising:

ink ejection devices having nozzles and arranged into primitive groups; and processing electronics in communication with the ink ejection devices, the processing electronics to:

receive data packets for controlling the ink ejection devices, each data packet including primitive firing data and fire signal selection data;

select, based on the fire signal selection data of a first data packet of the data packets, a fire signal from among a plurality of selectable fire signals switchable among the primitive groups, the plurality of selectable fire signals having different properties, and wherein different values of the fire signal selection data are to cause selections of different selectable fire signals of the plurality of selectable fire signals; and apply the selected fire signal to addressed ink ejection devices of the ink ejection devices based on the primitive firing data of the first data packet.

2. The printhead assembly of claim 1, further comprising ink feed slots, and wherein the primitive groups include columns of the ink ejection device nozzles positioned adjacent to and parallel with the ink feed slots.

3. The printhead assembly of claim 1, wherein ink ejection devices in at least one of the primitive groups have differing characteristics requiring different ones of the selectable firing signals.

4. The printhead assembly of claim 3, wherein the differing characteristics include one of a different ink color, a different ink drop weight, and a different energy requirement.

5. The printhead assembly of claim 1, wherein at least one of the primitive groups further includes devices other than ink ejection devices, the devices other than ink ejection devices having a different energy requirement then the ink ejection devices in the at least one of the primitive groups.

6. The printhead assembly of claim 1, wherein the different properties of the plurality of selectable fire signals comprise any or a combination of: different pulse widths, different pulse amplitudes, different duty cycles, different numbers of pulses, and different slew rates of pulse transitions.

7. The printhead assembly of claim 1, wherein the different properties of the plurality of selectable fire signals are for respective different characteristics of ink ejection devices in the primitive groups.

8. The printhead assembly of claim 1, wherein the fire signal selection data of the first data packet has a first value, and wherein the selected fire signal selected from among the plurality of selectable fire signals is a first fire signal, the processing electronics to further:

select, based on the fire signal selection data of a second data packet of the data packets having a different second value, a second fire signal from among the plurality of selectable fire signals, the second fire signal different from the first fire signal; and apply the second fire signal to further addressed ink ejection devices of the ink ejection devices based on the primitive firing data of the second data packet.

9. The printhead assembly of claim 1, wherein the processing electronics includes a multiplexor to receive as inputs the plurality of selectable fire signals, wherein the multiplexor is to select the fire signal from among the plurality of selectable fire signals based on the fire signal selection data in the first data packet provided to the multiplexor.

10. A method, comprising:

receiving, at a printhead assembly including fluid ejection devices having nozzles and arranged into primitive groups, data packets for controlling the fluid ejection devices, each data packet including primitive firing data and fire signal selection data;

selecting, based on the fire signal selection data of a first data packet of the data packets, a fire signal from among a plurality of selectable fire signals switchable among the primitive groups, the plurality of selectable fire signals having different properties, and wherein different values of the fire signal selection data are to cause selections of different selectable fire signals of the plurality of selectable fire signals; and applying the selected fire signal to addressed fluid ejection devices of the fluid ejection devices based on the primitive firing data of the first data packet.

11. The method of claim 10, wherein the fluid ejection devices in at least one of the primitive groups have differing characteristics requiring different ones of the selectable firing signals, the differing characteristics including one of a different color, a different fluid drop weight, and a different energy requirement.

12. The method of claim 11, wherein the fluid ejection devices in the at least one of the primitive groups have differing energy requirements, and wherein selecting the fire signal includes selecting a relatively higher energy firing signal from among the plurality of selectable fire signals in response to the fire signal selection data of the first data packet having a first value, and selecting a relatively lower energy firing signal from among the plurality of selectable fire signals in response to the fire signal selection data of the first data packet having a second value different from the first value.

13. The method of claim 10, wherein at least one of the primitive groups further includes devices other than fluid ejection devices, the devices other than fluid ejection devices having a different energy requirement then the fluid ejection devices in the at least one of the primitive groups.

14. The method of claim 10, wherein the fire signal selection data of the first data packet has a first value, and wherein the selected fire signal selected from among the plurality of selectable fire signals is a first fire signal, the method further comprising:

selecting, based on the fire signal selection data of a second data packet of the data packets having a different second value, a second fire signal from among the plurality of selectable fire signals, the second fire signal different from the first fire signal; and apply the second fire signal to further addressed fluid ejection devices of the fluid ejection devices based on the primitive firing data of the second data packet.

15. The method of claim 10, wherein the different properties of the plurality of selectable fire signals comprise any or a combination of: different pulse widths, different pulse amplitudes, different duty cycles, different numbers of pulses, and different slew rates of pulse transitions.

16. A printing system, comprising:

an interface for receiving a printhead assembly including fluid ejection devices having nozzles and arranged into primitive groups, the fluid ejection devices in one of the primitive groups having differing characteristics; and processing electronics in communication with the interface, the processing electronics comprising instructions executable on a processor to:

generate data packets for controlling the fluid ejection devices, each data packet including primitive firing data and fire signal selection data, the fire signal selection data indicating a fire signal for application to the primitive groups from among a plurality of selectable fire signals having different properties, the plurality of selectable fire signals switchable among the primitive groups based on the fire signal selection data in each respective data packet, wherein the fire signal selection data in each respective data packet is generated based on the differing characteristics of the fluid ejection devices in the one of the primitive groups; and transmit the data packets to the printhead assembly via the interface.

17. The printing system of claim 16, wherein the differing characteristics of the fluid ejection devices in the one of the primitive groups include one of a different color, a different fluid drop weight, and a different energy requirement, and wherein the different properties of the plurality of selectable fire signals comprise any or a combination of: different pulse widths, different pulse amplitudes, different duty cycles, different numbers of pulses, and different slew rates of pulse transitions.

18. The printing system of claim 16, wherein each data packet further includes nozzle address data for the fluid ejection devices.

19. The printing system of claim 16, wherein the interface includes a first data interface and a second data interface, wherein the first data interface is a unidirectional data interface for transmitting the data packets, wherein the second data interface is a bidirectional data interface for configuring the plurality of selectable fire signals, and wherein the first data interface is to operate at a relatively higher data rate than the second data interface.

20. The printing system of claim 16, wherein generating the data packets comprises:

generating a first data packet having first fire signal selection data to cause selection of a first fire signal of the plurality of selectable fire signals by the printhead assembly; and generating a second data packet having different second fire signal selection data to cause selection of a different second fire signal of the plurality of selectable fire signals by the printhead assembly, and wherein transmitting the data packets comprises transmitting the first and second data packets.

* * * * *